US008616262B2

(12) United States Patent
Meyer et al.

(10) Patent No.: US 8,616,262 B2
(45) Date of Patent: Dec. 31, 2013

(54) ADJUSTABLE FASTENING PLATE FOR TENSIONING A FLEXIBLE SHEET BY CABLES WITHOUT CHANGING THE SHAPE THEREOF

(75) Inventors: Yves Meyer, Rixheim (FR); Guillaume Weit Haller, Dessenheim (FR)

(73) Assignee: Normalu, Kembs (FR)

( * ) Notice: Subject to any disclaimer, the term of this patent is extended or adjusted under 35 U.S.C. 154(b) by 4 days.

(21) Appl. No.: 13/143,955

(22) PCT Filed: Jan. 8, 2010

(86) PCT No.: PCT/FR2010/000018

§ 371 (c)(1),
(2), (4) Date: Oct. 11, 2011

(87) PCT Pub. No.: WO2010/079290

PCT Pub. Date: Jul. 15, 2010

(65) Prior Publication Data

US 2012/0061039 A1 Mar. 15, 2012

(30) Foreign Application Priority Data

Jan. 9, 2009 (FR) ..... 09 00093
Jul. 6, 2009 (FR) ..... 09 03330

(51) Int. Cl.
*E06B 9/00* (2006.01)

(52) U.S. Cl.
USPC ..... 160/368.1; 160/354; 160/328; 52/222

(58) Field of Classification Search
USPC ..... 160/45, 83.1, 328, 369, 374.1, 378, 160/381, 84.07, 134, 97, 368.2; 52/222; 40/603, 604; 38/102.1, 102
See application file for complete search history.

(56) References Cited

U.S. PATENT DOCUMENTS 261,218 A * 7/1882 Foster ..... 160/368.2
823,096 A * 6/1906 Armstrong ..... 160/58.1

(Continued)

FOREIGN PATENT DOCUMENTS

DE 10224030 A1 12/2003

OTHER PUBLICATIONS

International Search Report of PCT/FR2010/000018; Mar. 24, 2010; Schnedler Marlon.
English abstract of DE 10224030.

*Primary Examiner* — Blair M. Johnson
(74) *Attorney, Agent, or Firm* — Bachman & LaPointe, P.C.

(57) ABSTRACT

The invention relates to an adjustable fastening plate (1) intended for a fake wall made of a flexible sheet (2) provided, along each of the edges thereof, with at least one loop (3) and a cable (4) placed inside said loops (3), said cables (4) being attached, by means of the slant of said plate (1), to the walls and/or the ceiling of an indoor space for keeping said sheet (2) in position. The invention is remarkable in that it includes a base plate (5) attached to the indoor space, a first arm (6) and a second arm (7) hinged to said base plate (5), first and second slides (8, 9) that each receive a cable (4) and which are slidable along said first and second arms (6, 7) so as to enable the tensioning of said cable (4), and an adjusting means (10) for adjusting the angular distance between the first and second arms (6, 7).

26 Claims, 4 Drawing Sheets

(56) References Cited

U.S. PATENT DOCUMENTS

| | | | | | |
|---|---|---|---|---|---|
| 916,832 | A | * | 3/1909 | Bittlinger et al. | 160/374 |
| 1,211,560 | A | * | 1/1917 | Eckert | 160/221 |
| 1,325,227 | A | * | 12/1919 | Blannkennagel | 160/83.1 |
| 2,897,002 | A | * | 7/1959 | Yovich | 296/95.1 |
| 3,529,653 | A | * | 9/1970 | Fey, Jr. | 160/374.1 |
| 3,949,802 | A | * | 4/1976 | Buratovich | 160/374.1 |
| 5,839,214 | A | * | 11/1998 | Peterson | 38/102.4 |
| 6,167,649 | B1 | | 1/2001 | Palmeri | |
| 6,412,536 | B1 | * | 7/2002 | Vannetta | 160/57 |
| 6,565,052 | B1 | * | 5/2003 | Doublet | 248/218.4 |
| 2012/0061039 | A1 | * | 3/2012 | Meyer et al. | 160/368.1 |

* cited by examiner

ADJUSTABLE FASTENING PLATE FOR TENSIONING A FLEXIBLE SHEET BY CABLES WITHOUT CHANGING THE SHAPE THEREOF

TECHNICAL FIELD

This invention relates to an adjustable fastening plate for tensioning without changing the shape, in particular via its angles, a sheet intended for the carrying out of false walls such as false ceilings and false walls.

BACKGROUND

The false walls stretched by the angles conventionally comprise at least one stretched flexible sheet made from an elastic material, for example made of vinyl polychloride (PVC), provided along each of its edges with at least one loop, and a cable housed in said loops, said cables being fastened to the walls or to the ceiling of an indoor space in a building in order to maintain said sheet in position.

One of the main difficulties encountered in the technique of installing this type of false wall is that this sheet, in order to provide a good appearance, must be strongly stretched. However, false walls are generally arranged in rooms with a relatively large surface area, which requires substantial tensioning forces to be exerted on each of the ends of the cables. Furthermore, the cables that have a certain elasticity have a tendency to become deformed in particular straight from their point of fastening under the effect of the tension exerted by the sheet. A sheet is then obtained of which the edges are not straight and which is generally wrinkled in the vicinity of its angles, which can damage the sheet and has an appearance which is not very pleasing.

Another difficulty consists in the tensioning of said cables because in general the access to the point of fastening of the latter is particularly exiguous in order to not alter the appearance of the entire false wall by leaving too much space between the latter and the wall or the ceiling.

SUMMARY

This invention therefore aims to overcome the disadvantages of prior art by providing a new system of angular fastening for these false walls.

In this respect, this invention has for object an adjustable fastening plate intended for the fastening and the tensioning of a false wall constituted of a flexible sheet provided along each of its edges with at least one loop and a cable housed in said loops, said cables being fastened by the slant of said plate to the walls and/or ceiling of an indoor space in order to maintain said sheet in position. Said plate is remarkable in that it includes a base plate comprising three exiting orifices and fastened to the indoor space by one of its orifices, a first arm hinged according to the axis of the second orifice of said base plate, a second arm hinged according to the axis of the third orifice of said base plate, a first and a second slide arranged respectively on the first and second arms, each receiving a cable and being able to slide along said first and second arms in order to allow for the tensioning of said cable, and a means of adjusting in order to adjust the angular distance between the first and second arms.

Through its design, this plate makes it possible to maintain, on the one hand, the sheet and, on the other hand, to exert sufficient tension on said sheet.

According to another characteristic, the plate adapts to different sheet format by allowing for an angular adjustment ranging from 0 to 180° by the slant of the sector.

According to a last characteristic, this plate makes it possible to exert sufficient tension on the cables placed in the peripheral loops after the fabric has been installed.

BRIEF DESCRIPTION OF THE DRAWINGS

Hereinafter will be described by way of a non-restricted example, an embodiment of this invention, in reference to the annexed drawings wherein.

DETAILED DESCRIPTION

Hereinafter will be described a use in horizontal position of the adjustable fastening plate for a false ceiling. This plate can of course also be used by vertical or even inclined false walls.

Figure 1:
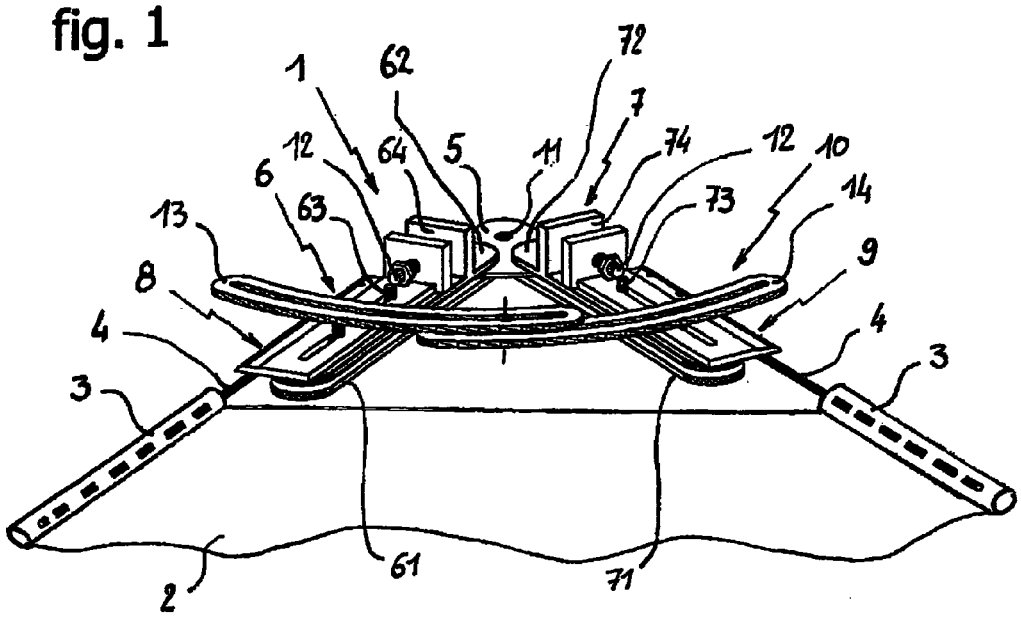
FIG. 1 is a front perspective view of an adjustable fastening plate according to the invention.
Figure 2:
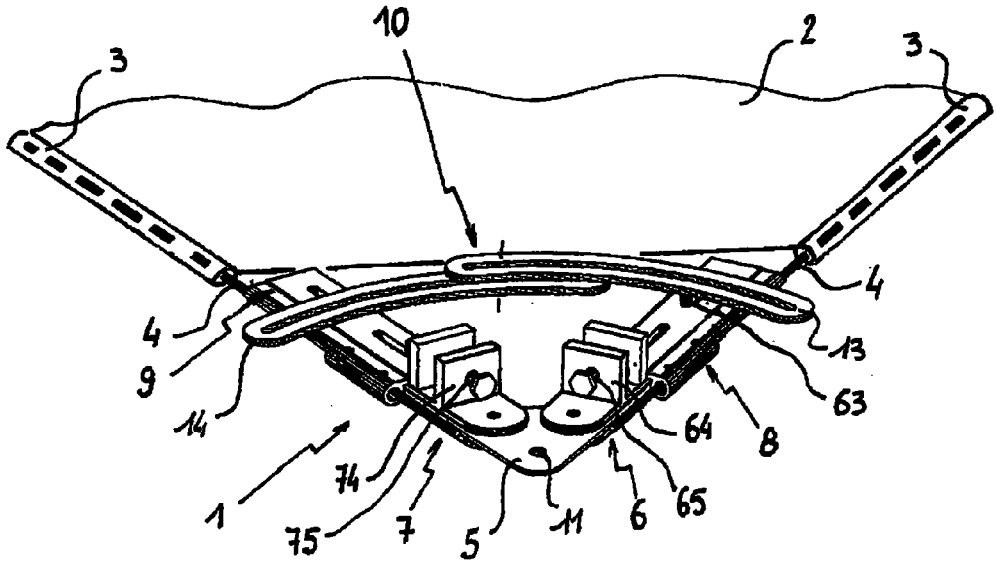
FIG. 2 is a rear perspective view of an adjustable fastening plate according to the invention.
Figure 3:
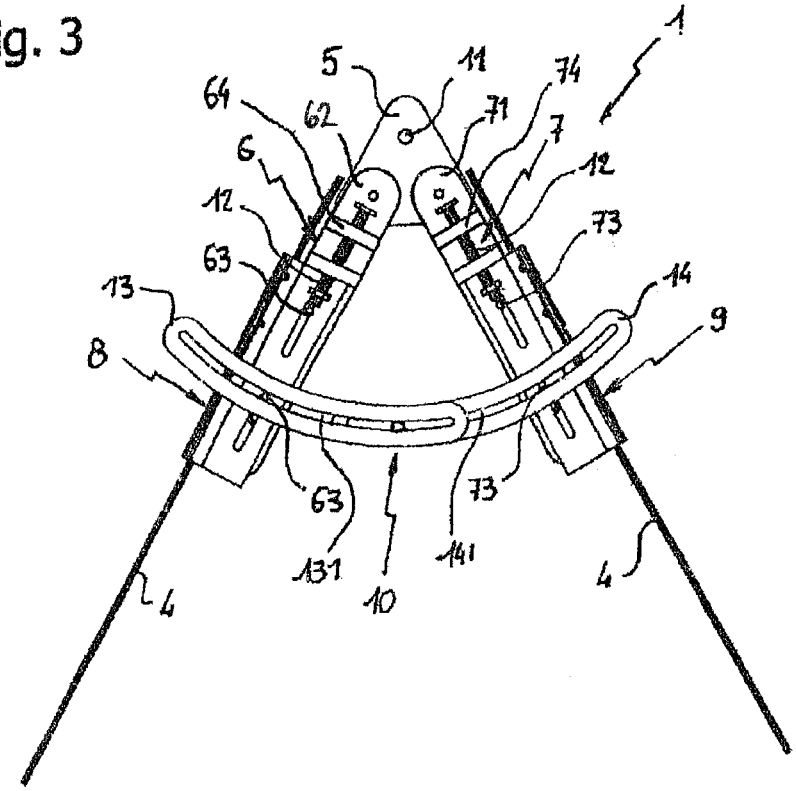
FIG. 3 is a top view of an adjustable fastening plate according to the invention without a sheet.

In reference to FIGS. 1 to 3, the plate 1 of adjustable fastening, according to the invention, is intended for the fastening and the tensioning of a flexible sheet 2 provided along each of its edges with at least one loop 3, and a cable 4 housed inside said loops 3, said cables 4 being fastened thanks to said plate 1 to the walls of an indoor space in a building in order to maintain said sheet 2 in position and as such form a false ceiling.

To do this, the plate 1 comprises a globally horizontal base plate 5 comprising three vertical axis exiting orifices 11 and fastened by one of said orifices 11 to the wall, a first arm 6 hinged according to the axis of the second orifice 11 of said base plate 5, a second arm 7 hinged according to the axis of the third orifice 11 of said base plate 5, a first and a second slide 8, 9 arranged respectively on the first and second arms 6, 7, each receiving a cable 4 and being able to slide along said first and second arms 6, 7 in order to allow for the tensioning of said cables 4; a means of adjusting 10 in order to adjust the angular distance between the first and second arms 6, 7.

The base plate 5 advantageously has a general triangle shape and comprises an orifice 11 in the vicinity of each of its three tops, two of its orifices 11 allowing for the hinging of the first and second arms 6, 7 and the third allowing for the fastening of the plate 1 to a wall of the indoor space by means of a screw tensioning device, for example.

The first arm 6 comprises a lower plate 61 and an globally horizontal upper plate 62 with extended shape, said upper and lower plates 61, 62 being superimposed, arranged on either side of the base plate 5, and hinged to the latter at one of their ends by a vertical axis bolt (not shown in order to avoid overloading the drawings) passing through one of the orifices 11 of said base plate 5.

Upper plate is used to designate the plate receiving the slide.

Said lower and upper plates 61, 62 are assembled together by two bolts (not shown), for example.

The upper plate 62 further comprises two tenons 63 arranged along its longitudinal axis, and a vertical tab 64 in the general shape of a parallelepiped of which two of its vertical faces are perpendicular to said longitudinal axis, said tenons 63 and the tab 64 coming perpendicularly from the upper face of the upper plate 62. The tab 64 further comprises a horizontal axis orifice 65 passing right through said tab 64.

Through analogy, the second arm 7 further comprises a lower plate 71 and an upper plate 72, said upper and lower plates 71, 72 being superimposed, arranged on either side of the base plate 5, and hinged to the latter at one of their ends by a vertical axis bolt (not shown in order to avoid overloading the drawings) passing through another orifice 11 of said base plate 5.

Said upper and lower plates 71, 72 are assembled together by two bolts (not shown), for example.

The upper plate 72 further comprises two tenons 73 arranged along its longitudinal axis, and a vertical tab 74 in the general shape of a parallelepiped of which two of its vertical faces are perpendicular to said longitudinal axis, said tenons 73 and tab 74 coming perpendicularly from the upper face of the upper plate 72. The tab 74 further comprises an orifice 75 with a horizontal axis passing right through said tab 74.

In a preferred embodiment and in order to standardize production and therefore reduce the costs, the first and second arms 6, 7 are advantageously identical.

Likewise, the tenons 63, 73 are more preferably countersunk head screws fastened in vertical axis threadings exiting respectively in the upper plates 62, 72. For reasons of compactness, the lower face of said upper plates 62, 72 comprises millings in order to receive the screw heads.

The plate 1, according to the invention, further comprises a first and a second slide 8, 9 arranged respectively on the top of the upper plates 62, 72 of the first and second arm 6, 7.

Figure 4:
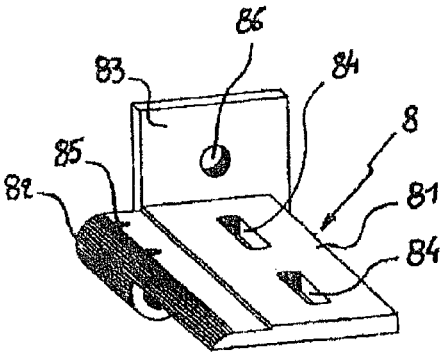
FIG. 4 is a perspective view of one of the slides of the adjustable fastening plate which makes it possible to fasten and tension the cables.

In reference to FIG. 4, the first slide 8 comprises a globally horizontal element 81 in the general shape of a flat and extended parallelepiped, a tube 82 along all or a portion of one of the longitudinal edges of said element 81 and a vertical tab 83 in the general shape of a parallelepiped extending perpendicularly from one of the lateral edges of the lower face of the element 81.

The element 81 of the first slide 8 comprises two holes 84 more preferably of oblong shape, passing right through said element 81 vertically and being able to cooperate with the tenons 63 of the upper plate 62 of the first arm 6 in order to allow for the sliding of the first slide 6 on the latter.

The tube 82 is able to receive a cable 4 in order to allow it to be made integral with the plate 1. It comprises for this, two radial orifices 85 exiting inside of said tube 82 and allowing for the installation of means of tightening (not shown) in order to immobilize the cable 4 inside the tube 82. As such, the orifices 85 are more preferably threadings and the means for tightening screws.

The tab 83 comprises a horizontal axis orifice 86 located in the vicinity of the middle of the vertical face coming from the lateral edge of the element 81 and passing right through said tab 83.

Figure 5:
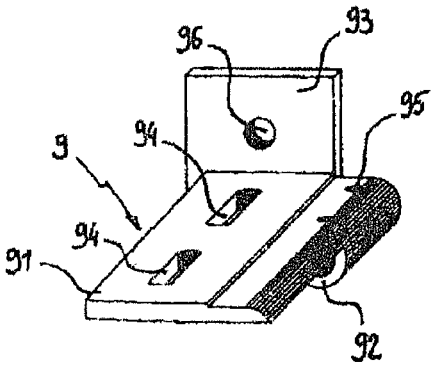
FIG. 5 is a perspective view of the other slide of the adjustable fastening plate which makes it possible to fasten and tension the cables.
Figure 6:
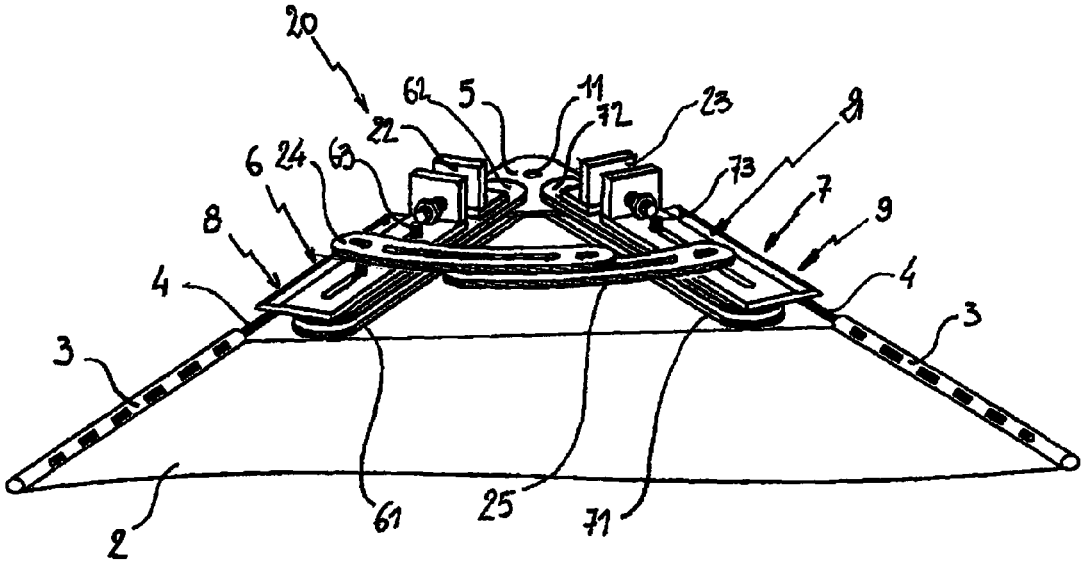
FIG. 6 is a front perspective view of a second alternative of the adjustable fastening plate according to the invention.
Figure 7:
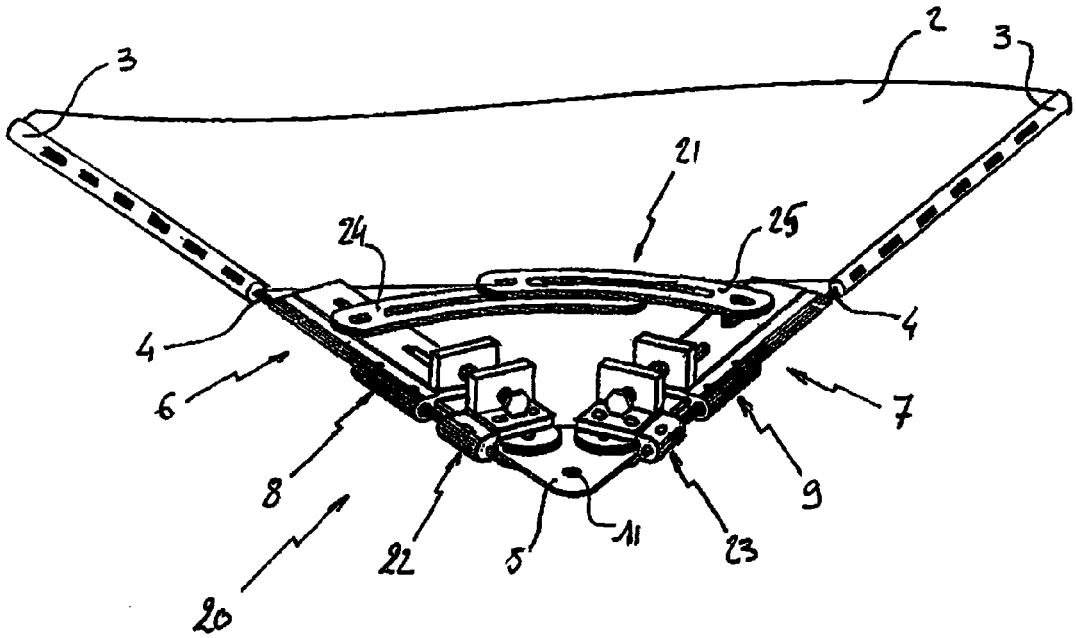
FIG. 7 is a rear perspective view of the second alternative of the adjustable fastening plate according to the invention.
Figure 8:
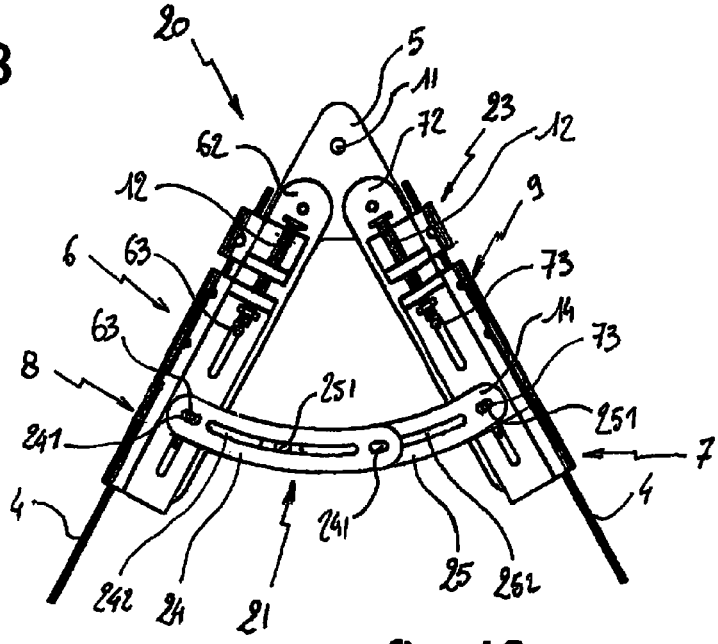
FIG. 8 is a top view of the second alternative of the adjustable fastening plate according to the invention without a sheet.
Figure 9:
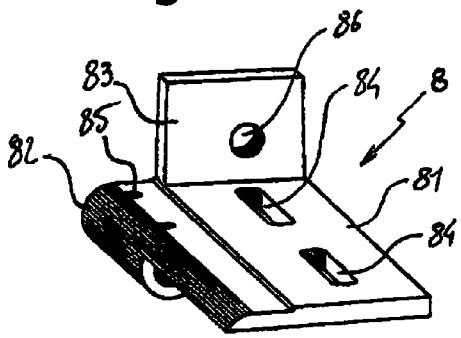
FIG. 9 is a perspective view of one of the slides of the second alternative of the adjustable fastening plate which makes it possible to fasten and tension the cables.
Figure 10:
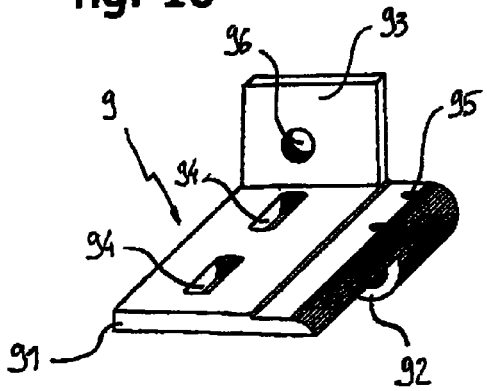
FIG. 10 is a perspective view of the other slide of the second alternative of the adjustable fastening plate which makes it possible to fasten and tension the cables.
Figure 11:
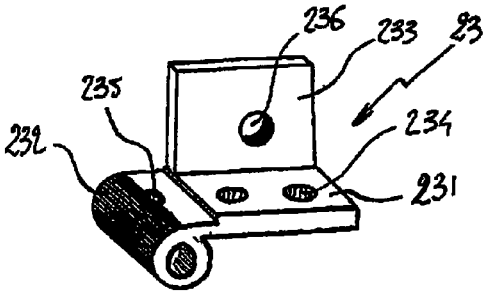
FIG. 11 is a perspective view of one of the tensioning members of the second alternative of the adjustable fastening plate which makes it possible to fasten and tension the cables.
Figure 12:
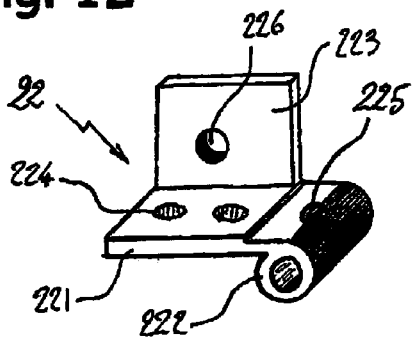
FIG. 12 is a perspective view of the other tensioning member of the second alternative of the adjustable fastening plate which makes it possible to fasten and tension the cables.

Through analogy and in reference to FIG. 5, the second slide 9 comprises a globally horizontal element 91 in the general shape of a flat and extended parallelepiped, a tube 92 along all or a portion of one of the longitudinal edges of said element 91 and a vertical tab 93 in the general shape of a parallelepiped extending perpendicularly from one of the lateral edges of the lower face of said element 91.

The tube 92 is able to receive a cable 4 and comprises two radial orifices 95 allowing for the installation of means of tightening (not shown) in order to immobilize the cable 4 inside the tube 92. As such, the orifices 95 are more preferably threadings and the means for tightening screws.

The tab 93 comprises a horizontal axis orifice 96 located in the vicinity of the middle of the vertical face coming from the lateral edge of the element 91 and passing right through said tab 93.

The orifices 86, 96 of the tabs 83, 93 are more preferably threadings that are globally coaxial with the orifices 65, 75 of the respective tabs 64, 74 of the first and second arms 6, 7, when the first and second slides 8, 9 are positioned on the latter.

For reasons of standardization, the tabs 83, 93 the first and second slides 8, 9 have the same dimensions as the tabs 64, 74 of the first and second arms 6, 7.

However, in order to prevent the cables 4, which pass in the tubes 82, 92, from being located in the zone between the first and the second arms 6, 7, the first and second slides 8, 9 are advantageously symmetrical in relation to the axis of their holes 84, 94.

The plate 1, according to the invention, further comprises at least two means of tensioning 12. One of said means of tensioning 12 is able to cooperate simultaneously with the orifice 65 of the first arm 6 and the orifice 86 of the first slide 8, and the other is able to cooperate simultaneously with the orifice 75 of the second arm 7 and the orifice 96 of the second slide 9 in order to slide said slides 8, 9 along their holes 84, 94 pressing against the tenons 63, 73 in order to tension the cables 4.

The means of tensioning 12 are advantageously screws introduced into the orifices 65, 75 of the first and second arms 6, 7 and screwed into the orifices 86, 96 (advantageously threaded) of the first and second slides 8, 9 in such a way that the rotation of the screws causes a displacement of the first and second slides 8, 9 in relation to the first and second arms 6, 7 and therefore a tension (or a relaxing according to the direction of displacement) of the cables 4. Once the desired tension of the cables 4 is obtained, the position of the first and second slides 8, 9 is locked by screwing nuts on the means of tensioning 12 in order to create a locknut and immobilize the first and second slides 8, 9 in relation to the first and second arms 6, 7. In addition, to increase the locking and prevent the butting of the first and second slides 8, 9, a nut can be screwed on the tenons 63, 73 located near the tabs 83, 93.

In order to prevent a butting of the slides 8, 9, the axes of the orifices 65, 75, 86, 96 and the longitudinal axes of the holes 84, 94 belong advantageously to the same vertical plane.

The plate 1, according to the invention, further comprises a means of adjusting 10. Said means of adjusting is more preferably a first and a second sector 13, 14 arranged respectively on said first and second slides 8, 9, able to slide in relation to one another then to be made integral with one another, but also able to slide in relation to said first and second slides 8, 9. Each sector 13, 14 is a globally horizontal blade in the general shape of a crown arch comprising respectively a hole 131, 141 along its median line. The first and second sectors 13, 14 are made integral together at one of their ends by at least one means of fastening (not shown), which is advantageously a bolt simultaneously passing through the hole 131 of the first sector 13 and the hole 141 of the second sector 14. This configuration makes it possible to slide said first and a second sector 13, 14 in relation to one another in order to vary the overall length of the unit constituted by the first and a second sector 13, 14.

Said ensemble is then fastened to the free end of the first sector 13 on the top of the first slide 8 and to the free end of the second sector 14 on the top of the second slide 9, engaging the tenon 63 located at the free end of the first arm 6 in the free end of the hole 131 of the first sector 13 and the tenon 73 located at the free end of the second arm 7 in the free end of the hole 141 of the second sector 14.

This configuration makes it possible to adjust the relative angular distance between the first and second arms 6, 7 by sliding the tenons 63, 73 respectively along the holes 131, 141. Once the desired distance is obtained, the position of the first and second arm 6, 7 is locked by screwing for example a nut on the tenons 63, 73 in order to immobilize the first and a second sector 13, 14 in relation to the first and second arms 6, 7.

It is easily understood that for sheets 2 comprising acute angles, it is possible to use only a single sector 13 arranged on said first and second slides 8, 9 and able to slide in relation to said first and second slides 8, 9 without leaving the scope of this invention.

However, the use of a first and a second advantageously identical sector 13, 14 allows for an angular distance of the first and second arms 6, 7 between them ranging from 0 to 180 degrees.

As such, the plate 1, according to the invention, is particularly adapted to the sheets 2 of which the contour has a general polygon shape and which have loops along each of their edges, but also to the sheets 2 of which the contour is a continuous curve and which has loops along a portion of their periphery.

Likewise, for obvious questions of lightness, most of the elements constituting the plate 1, according to the invention, are made from a light alloy, for example an aluminium alloy.

Finally, in order to avoid altering the sheet 2 and injuring the installer in charge with setting up the false ceiling, most of the elements comprising the plate 1, according to the invention, do not have any sharp angles.

During the mounting of a false ceiling in a room, the installer will have provided the upper end of the walls with means of fastening such as hooks able to cooperate with the free orifice 11 of the base plate 5 of the plates 1. The sheet 2, more preferably polygonal, is provided along each of its edges with loops 3 wherein cables 4 are housed. At each top of the sheet 2, a plate 1 will be placed and then the ends of the cables 4 will be inserted and then immobilized joining said tops in the respective tubes 82, 92 of the first and second slides 8, 9. Then, the cables 4 will be tensioned using means of tensioning 12 and of displacing said slides 8, 9. Finally, the first and second sectors 13, 14 will be adjusted, in order to obtain the desired angular distance, between the first and second arms 6, 7 of each of the plates 1 and in this way suppress the wrinkled appearance of the sheet 2.

However, with a plate 1 such as that described previously the tensioning of the cables 4 can be delicate as the means of tensioning 12 have limited courses of travel and therefore do not always make it possible to obtain a perfect tensioning of said cables 4.

As such, in order to overcome this disadvantage, this invention also has for object a second alternative embodiment, according to which in reference to FIGS. 6 to 12, the plate 20 is similar to the previously described plate 1 in that it comprises a globally horizontal base plate 5 comprising three vertical axis orifices 11 exiting and fastened by one of said orifices 11 to the wall, a first arm 6 hinged according to the axis of the second orifice 11 of said base plate 5, a second arm 7 hinged according to the axis of the third orifice 11 of said base plate 5, a first and a second slide 8, 9 arranged respectively on the first and second arms 6, 7, each receiving a cable 4 and being able to slide along said first and second arms 6, 7 in order to allow for the tensioning of said cables 4; a means of adjusting 21 in order to adjust the angular distance between the first and second arms 6, 7.

Furthermore, the first and second arms 6, 7 of the plate 20 each comprise a lower plate 61, 71 and an upper plate 62, 72, said upper and lower plates 61, 62, 71, 72 being superimposed, hinged to said base plate 5 and assembled between them by two bolts (not shown), for example.

The upper plates 62, 72 comprise two tenons 63, 73 arranged along its longitudinal axis and coming perpendicularly from the upper face of said upper plates 62, 72.

However, the plate 20 are differentiated from the previously described plate 1 in that its upper plates 62, 72 do not comprise tabs 64, 74 and that it comprises instead a first and a second tensioning member 22, 23 of cables 4, each being fastened respectively on each of the first and second arms 6, 7, said first and second tensioning members 22, 23 being able to cooperate with respectively the first and second slides 8, 9.

Through analogy with the first and second slides 8, 9, the first and second tensioning members 22, 23 each advantageously and respectively comprise a globally horizontal element 221, 231 in the general shape of a flat and extended parallelepiped, a tube 222, 232 along all or a portion of one of the longitudinal edges of said element 221, 231 and a vertical tab 223, 233 in the general shape of a parallelepiped extending perpendicularly from one of the lateral edges of the upper face of the element 221, 231.

Likewise, the elements 221, 231 include advantageously and respectively two orifices 224, 234 passing vertically right through said elements 221, 231 and being able to cooperate, for example, with screws (not shown in the figures) in order to fasten said elements 221, 231 respectively on the upper plates 62, 72 of the first and second arm 6, 7.

Each tube 222, 232 is able to receive a cable 4 in order to allow for the tensioning of said cable 4. It comprises for this, at least one radial orifice 225, 235 exiting inside of said tube 222, 232 and allowing for the installation of means of tightening (not shown) in order to immobilize the cable 4 inside the tube 222, 232. As such, the orifice 225, 235 is more preferably a threading and the means for tightening screws.

The tab 223, 233 comprises a horizontal axis orifice 226, 236 located in the vicinity of the middle of the vertical face coming from the lateral edge of the element 221, 231 and passing right through said tab 223, 233.

The orifices 226, 236 of the tabs 223, 233 are more preferably smooth holes that are globally coaxial with the orifices 86, 96 of the respective tabs 83, 93 of the first and second slides 8, 9, when the latter are positioned respectively on the first and second arms 6, 7.

Through analogy with the first and second slides 8, 9, the first and second tensioning members 22, 23 are symmetrical in relation to the axis of their orifices 226, 236.

As the previously described plate 1, the plate 20, according to the invention, further comprises at least two means of tensioning 12. One of said means of tensioning 12 is able to cooperate simultaneously with the orifice 226 of the first tensioning member 22 and the orifice 86 of the first slide 8, and the other is able to cooperate simultaneously with the orifice 236 of the second tensioning member 23 and the orifice 96 of the second slide 9 in order to slide said slides 8, 9 along their holes 84, 94 pressing on the tenons 63, 73 in order to tension the cables 4.

Moreover, the plate 20 is also differentiated from the previously described plate 1 by its means of adjusting 21 in order to adjust the angular distance between the first and second arms 6, 7. Indeed, said means of adjusting 21 comprises a first and a second sector 24, 25 fastened at one of their ends respectively on said first and second slides 8, 9 and able to slide one in relation to the other then be made integral together. Each sector 24, 25 is a globally horizontal blade in the general shape of a crown arch respectively comprising an orifice 241, 251 exiting at each of its ends and a hole 242, 252 along its median line located between said orifices 241, 251.

The first and second sectors 24, 25 are made integral together at one of their ends via two means of fastening (not shown), which are advantageously bolts. As such, a first means of fastening simultaneously crosses one of the orifices 241 of the first sector 24 and the hole 252 of the second sector 25, and the second means of fastening simultaneously crosses one of the orifices 251 of the second sector 25 and the hole 242 of the first sector 24. This configuration makes it possible to slide said first and a second sector 24, 25 in relation to one another so as to vary the overall length of the unit constituted by the latter and therefore obtain the desired angular distance between the first and second arm 6, 7.

Said unit is fastened to the free end of the first sector 24 on the first slide 8 and to the free end of the second sector 25 on the second slide 9, engaging the tenon 63 located at the free end of the first arm 6 in the free orifice 241 of the first sector 24 and the tenon 73 located at the free end of the second arm 7 in the free orifice 251 of the second sector 25. Then, for example, a nut is screwed on the tenons 63, 73 in order to immobilize the first and a second sector 24, 25 in relation to the first and second arms 6, 7.

During the mounting of a false ceiling in a room, the installer will have provided the upper end of the walls with means of fastening such as hooks able to cooperate with the free orifice 11 of the base plate 5 of the plates 20. The sheet 2, more preferably polygonal, is provided along each of its edges with loops 3 wherein cables 4 are housed. At each top of the sheet 2, a plate 20 is placed and the first and second sectors 22, 23 are adjusted, in order to obtain the desired angular distance between the first and second arms 6, 7 of each of the plates 1 and in this way suppress the wrinkled appearance of the sheet 2.

Then, for the tensioning of the cables 4, we will proceed in the following manner:

beforehand, care is taken on the plate 20, on the one hand, to loosen the nuts on the tenons 63, 73 in order to allow for the sliding of the first and second slides 8, 9 and, on the other hand, to separate as much as possible, using means of tensioning 12, the first and second slides 8, 9 from the first and second tensioning members 22, 23.

on the one hand, the end of one of the cables 4 joining said tops in the tube 82 of the first slide 8 is inserted then in the tube 222 of the first tensioning member 22 and, on the other hand, the end of the other of the cables 4 in the tube 92 of the second slide 9 then in the tube 232 of the second tensioning member 23, said cables 4 are blocked only in the tubes 82, 92 of the first and second slides 8, 9 using associated means of tightening, using means of tensioning 12, the first and second slides 8, 9 are brought together until contact respectively of the first and second tensioning members 22, 23, said cables 4 are blocked in the tubes 222, 232 of the first and second tensioning members 22, 23 using associated means of tightening and then said cables 4 are unlocked in the tubes 82, 92 of the first and second slides 8, 9, using means of tensioning 12, the first and second slides 8, 9 are separated as much as possible from the first and second tensioning members 22, said cables 4 are blocked in the tubes 82, 92 of the first and second slides 8, 9 using associated means of tightening and then said cables 4 are unlocked in the tubes 222, 232 from the first and second tensioning members 22, 23, using means of tensioning 12, the first and second slides 8, 9 are brought together until contact if possible, respectively of the first and second tensioning members 22, 23, the 4 preceding steps are then repeated until an adequate tension of the cables 4 is obtained, then all the means of tightening and the nuts are blocked definitively on the tenons 63, 73 of the first and second arms 6, 7.

Once the desired tensioning of the cables 4 is obtained, the position of the first and second slides 8, 9 is locked by screwing the nuts on the means of tensioning 12 in order to create a locknut and immobilize first and second slides 8, 9 in relation to the first and second arms 6, 7. In addition, in order to increase the locking and prevent the butting of the first and second slides 8, 9, a nut can be screwed on the tenons 63, 73 located near the tabs 83, 93.

Moreover, it is understood that the tenons 63, 73 of the respective upper plates 62, 72 of the first and second arms 6, 7 can be replaced with bolts or any other equivalent means without leaving the scope of this invention.

Finally, it is of course obvious that this invention is not limited to the alternative embodiments described; but that it can be modified or adapted according to special needs or requirements, without however leaving the scope of the invention.

The invention claimed is:

1. A plate for adjustable fastening intended for the fastening and the tensioning of a false wall constituted of a flexible sheet provided along each of its edges with at least one loop and a cable housed in said loops, said cables configured to be fastened by said plate to at least one of said false walls and a ceiling of an indoor space in order to maintain said sheet in position, the plate comprising:

a base plate comprising three through orifices, the base plate being configured to be fastened to the indoor space by one of said orifices, a first arm hinged according to the axis of the second orifice of said base plate, a second arm hinged according to the axis of the third orifice of said base plate, and a first and a second slide arranged respectively on the first and second arms, each configured to receive one of said cables and to slide along said first and second arms in order to allow for the tensioning of said cable, and a means of adjusting in order to adjust the angular distance between the first and second arms.

2. The plate according to claim 1, wherein the means of adjusting is a sector arranged on said first and second slides and able to slide in relation to said first and second slides.

3. The plate according to claim 1, wherein the means of adjusting is a first and a second sector arranged respectively on said first and second slides, able to slide in relation to one another then to be made integral together, but also able to slide in relation to said first and second slides.

4. The plate according to claim 3, wherein each sector is a globally horizontal plate in the general shape of a crown arch comprising a hole along its median line.

5. The plate according to claim 1, wherein the first arm and the second arm include respectively a lower plate and an upper plate, said upper and lower plates being of extended shape, superimposed, arranged on either side of the base plate, hinged to the latter base plate at one of their ends and assembled to one another.

6. The plate according to claim 5, wherein the upper plates each comprise two tenons arranged along their longitudinal axis and a tab, said tenons and tab coming perpendicularly from the upper face of said upper plates and said tabs comprising an orifice passing right through them.

7. The according to claim 1, wherein the first arm and the second arm are identical.

8. The plate according to claim 1, wherein the first slide and the second slide comprise respectively an element in the general shape of a flat and extended parallelepiped, a tube along all or a portion of one of the longitudinal edges of said element, and a tab in the general shape of a parallelepiped extending perpendicularly from one of the lateral edges of the lower face of said element and comprising an orifice passing right through it.

9. The plate according to claim 8, wherein the respective elements of the first and second slides each include two holes able to cooperate respectively with the tenons of the upper plates of the first and second arms.

10. The plate according to claim 8, wherein the respective tubes of the first and second slides are able to each receive one of said cables and to allow for fastening of said cables with the plate.

11. The plate according to claim 9, wherein the first and second slides are symmetrical in relation to the axis of their holes.

12. The plate according to claim 9, wherein the axes of the orifices are coaxial and belong to the same plane as the longitudinal axes of the holes.

13. The plate according to claim 12, further comprising two means of tensioning, one of said means of tensioning being able to cooperate simultaneously with the orifice of the first arm and the orifice of the first slide, and the other being able to cooperate simultaneously with the orifice of the second arm and the orifice of the second slide in order to slide said slides along their holes pressing on the tenons in order to tension the cables.

14. The plate according to claim 13, wherein the means of tensioning are bolts.

15. The plate according to claim 1, further comprising a first and a second tensioning member of said cables, each being fastened respectively on each of the first and second arms, in that the means of adjusting comprises a first and a second sector fastened at one of their ends respectively on said first and second slides and able to slide in relation to one another then to be made integral together and in that the first arm and the second arm include respectively a lower plate and an upper plate, said upper and lower plates being of extended shape, superimposed, hinged from the base plate and assembled to one another, the upper plates each comprising two tenons arranged along their longitudinal axis and coming perpendicularly from the upper face of said upper plates.

16. The plate according to claim 15, wherein the first and second tensioning members each comprise a globally horizontal element in the general shape of a flat and extended parallelepiped, a tube along all or a portion of one of the longitudinal edges of said element and a tab in the general shape of a parallelepiped extending perpendicularly from the upper face of the element and comprising an exiting orifice.

17. The plate according to claim 16, wherein each tube is able to receive one of said cables in order to allow for its tensioning the tube comprising at least one radial orifice exiting inside said tube and allowing for the installation of means of tightening in order to immobilize the cable inside the tube.

18. The plate according to claim 15, wherein the first and second tensioning members are symmetrical.

19. The plate according to claim 15, wherein each sector is a globally horizontal blade in the general shape of a crown arch comprising respectively an orifice exiting at each of its ends and a hole along its median line located between said orifices.

20. The plate according to claim 15, wherein the first slide and the second slide comprise respectively an element in the general shape of a flat and extended parallelepiped, a tube along all or a portion of one of the longitudinal edges of said element, and a tab in the general shape of a parallelepiped extending perpendicularly from one of the lateral edges of the lower face of said element and comprising an orifice passing right through it.

21. The plate according to claim 20, wherein the respective elements of the first and second slides each include two holes able to cooperate respectively with the tenons of the upper plates of the first and second arms.

22. The plate according to claim 20, wherein the respective tubes of the first and second slides are able to each receive one of said cables and allow for its fastening with the plate using a means of tightening.

23. The plate according to claim 21, wherein the first and second slides are symmetrical in relation to the axis of their holes.

24. The plate according to claim 20, wherein the axes of the orifices of the first and second tensioning members and those of the orifices of the first and second slides are respectively coaxial.

25. The plate according to claim 24, further comprising two means of tensioning, one of said means of tensioning being able to cooperate simultaneously with the orifice of the first tensioning member and the orifice of the first slide, and the other being able to cooperate simultaneously with the orifice of the second tensioning member and the orifice of the second slide in order to slide said slides along their holes pressing on the tenons in order to tension the cables.

26. The plate according to claim 25, wherein the means of tensioning are bolts.

* * * * *